US005152622A

United States Patent [19]

Rasmussen et al.

[11] Patent Number: 5,152,622

[45] Date of Patent: Oct. 6, 1992

[54] PRINTER WITH IMPROVED ANTI-SKEW MECHANISMS

[75] Inventors: Steve O. Rasmussen, Vancouver; Allan G. Olson, Camas; Vance M. Stephens; William R. Huseby, both of Vancouver, all of Wash.

[73] Assignee: Hewlett-Packard Company, Palo Alto, Calif.

[21] Appl. No.: 722,744

[22] Filed: Jun. 28, 1991

Related U.S. Application Data

[63] Continuation of Ser. No. 451,286, Dec. 14, 1989, abandoned.

[51] Int. Cl.[5] ..... B41J 11/42

[52] U.S. Cl. ..... 400/579; 400/624; 400/629; 400/642; 400/643; 271/127; 271/240; 271/160; 271/222; 355/311

[58] Field of Search ..... 400/579, 624, 629, 642–643, 400/645, 647, 647.1, 352–354.5; 271/127, 240, 160, 161, 171, 222, 223; 355/311

[56] References Cited

U.S. PATENT DOCUMENTS

| | | | |
|---|---|---|---|
| 442,028 | 12/1890 | Field | 400/645 |
| 973,385 | 10/1910 | Rejch | 400/645 |
| 1,104,015 | 7/1914 | Stickney | 400/648 |
| 1,162,507 | 11/1915 | Petermann | 400/645 |
| 3,369,804 | 2/1968 | Schulze et al. | 27/223 |
| 3,642,273 | 2/1972 | Baglio | 271/171 |
| 4,030,725 | 6/1977 | Fukui et al. | 271/171 |
| 4,056,193 | 11/1977 | Yoshida | 271/171 |
| 4,219,192 | 8/1980 | Burke | 271/127 |
| 4,318,541 | 3/1982 | Nagel et al. | 271/222 |
| 4,429,865 | 2/1984 | Okada | 271/127 |
| 4,457,507 | 7/1984 | Ishikawa et al. | 271/171 |
| 4,643,602 | 2/1987 | Ikeda et al. | 400/354 |
| 4,786,039 | 11/1988 | Ito | 271/223 |
| 4,874,160 | 10/1989 | Yamamoto | 271/171 |

FOREIGN PATENT DOCUMENTS

| | | | |
|---|---|---|---|
| 48568 | 1/1938 | France | 271/127 |
| 325880 | 4/1935 | Italy | 271/127 |
| 0073874 | 4/1985 | Japan | 400/618 |
| 0165276 | 8/1985 | Japan | 400/579 |
| 0160268 | 7/1986 | Japan | 400/352 |
| 0188337 | 8/1986 | Japan | 271/127 |
| 0282028 | 11/1988 | Japan | 271/127 |
| 2061231 | 5/1981 | United Kingdom | 271/127 |

*Primary Examiner*—Eugene H. Eickholt

[57] ABSTRACT

The invented printer includes a paper drive and mechanisms which hold paper in proper alignment in the drive. Specifically, it includes a pressure plate capable of bringing a sheet of paper into contact with a drive roller so that the paper is properly aligned, a wrapper which keeps paper in proper contact with the drive roller, a media edge contactor that presses against paper, a carriage guide support which helps to insure proper alignment of the paper during printing, and a back-out restraint to prevent paper from backing out of the printer.

7 Claims, 8 Drawing Sheets

PRINTER WITH IMPROVED ANTI-SKEW MECHANISMS

CROSS REFERENCE TO RELATED APPLICATION

This is a continuation of copending application(s) Ser. No. 07/451,286 filed on Dec. 14, 1989, now abandoned.

TECHNICAL FIELD

This invention relates to a printer with improved anti-skew performance and, more particularly, to a printer which reduces paper skew by insuring alignment while paper is fed through the printer both before and during printing.

BACKGROUND ART

Printers mark images on a medium. To achieve acceptable quality in output, the printed image must be properly aligned on the medium, and as a consequence, printers are designed with anti-skew mechanisms to insure such alignment.

Skew is an oblique course or a deviation from a predetermined straight line. For example, as paper is fed through a printer, it may buckle or twist. If an image is then printed, it will be skewed.

Skew can be caused by many factors. For instance, a printer may feed paper irregularly-driving one side more than the other, with the outcome that different lines of the printed image will not be parallel. Additionally, when paper is initially fed into a printer, it may not be properly aligned. If so, the image will be incorrectly positioned on the page. Often, as paper is fed through a printer, the paper is forced to make a significant turn. Because the paper resists turns, it may move away from the drive mechanism and cause a skewed print image. Variations in parts, media and product handling may also cause skew.

To prevent skew, printers are usually equipped with special paper guides and intricate drive mechanisms. Hewlett-Packard's DeskJet® printer, as disclosed in U.S. Pat. No. 4,728,963, is an example of a printer with effective anti-skew features.

Nevertheless, even the best presently existing printers often print skewed images. This invention offers a printer featuring significantly improved anti-skew design.

DISCLOSURE OF THE INVENTION

The invented "Printer with Improved Anti-skew Mechanisms" includes a paper drive with drive rollers, and unique mechanisms which hold paper in proper alignment while it is handled by the drive. Specifically, the printer of the present invention includes a pressure plate that initially brings paper into contact with the drive rollers so that the former is properly aligned, a wrapper which keeps paper in proper contact with the rollers, a media edge contacter that presses against paper, a carriage guide support which helps to insure proper alignment during printing, and a back-out restraint to prevent paper from backing out of the printer.

DETAILED DESCRIPTION AND BEST MODE FOR CARRYING OUT THE INVENTION

Figure 1:
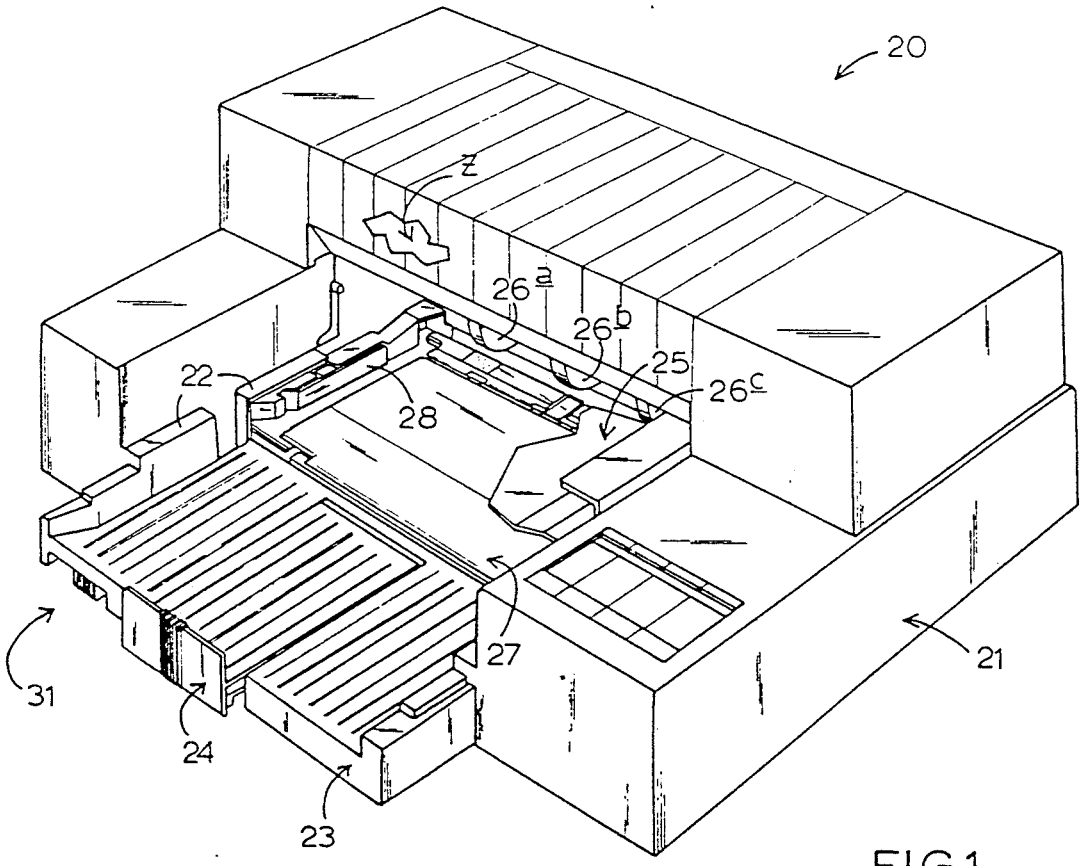
FIG. 1 is a top perspective view of a printer constructed according to the present invention.

The invented anti-skew mechanisms may be incorporated in a printer, such as the one shown in FIG. 1 at 20. Printer 20 includes a housing 21 having, among other things, flanges such as those shown at 22, a lower paper tray 23, and a paper back-out restraint 24. A stack of sheet print media (not shown) on which printer 20 will print (typically paper) is loaded into tray 23. After printing, the paper is collected in an upper paper tray 25 (shown fragmentally in FIG. 1) resting on flanges 22 and located immediately above tray 23.

The specific printing mechanism, or means, paper-drive mechanism, or drive means, circuitry, and other elements necessary for printer 20 to operate may be those used in presently existing printers. U.S. Pat. No. 4,728,963 discloses such elements.

The paper-drive mechanism incorporated in printer 20 includes drive rollers **26*a*, 26*b*, 26*c*. These rollers contact the top sheet of paper in tray 23 and drive it through a print zone Z, located generally inside the upper portion of housing 21 as seen in FIG. 1, and into upper tray 25**. The drive rollers are driven by any known method.

FIG. 1 also shows components of several of the invented anti-skew mechanisms and their positions within the printer. Included are a pressure plate 27, a media edge contacter 28, and back-out restraint 24. These mechanisms also include a wrapper 29 (see FIGS. 9 and 10) and a carriage guide support, or support means, 30 (see FIG. 16). Each of these structures will be discussed in turn. Plate 27, edge contacter 28, and wrapper 29, either collectively or individually form what is referred to herein as media alignment means. The media edge contacter, along with back-out restraint 24 and lower tray 23 together make up a supply means generally pointed to in FIG. 1 by arrow 31.

The structure of plate 27 is shown in FIGS. 2–5, inclusive. Plate 27 includes a platen 32 connected to printer 20 by hinges 33, and taking the form generally of a rectangular piece of aluminium. The top surface of platen 32 includes a recessed area 34.

A relatively moveable member 35 is attached to platen 32 and includes two, laterally spaced projections 36 and 37. These projections may be made of cork. Additionally, member 35 includes a sloped, lead-in surface 38. The attachment between platen 32 and member 35 is what might be thought of as a limited wobble attachment which allows the moveable member to rock slightly, as shown by the double arrow in FIG. 4 relative to the plate around an axis shown generally at 39. Any attachment that allows member 35 to rock around axis 39 may be used.

Figure 2:
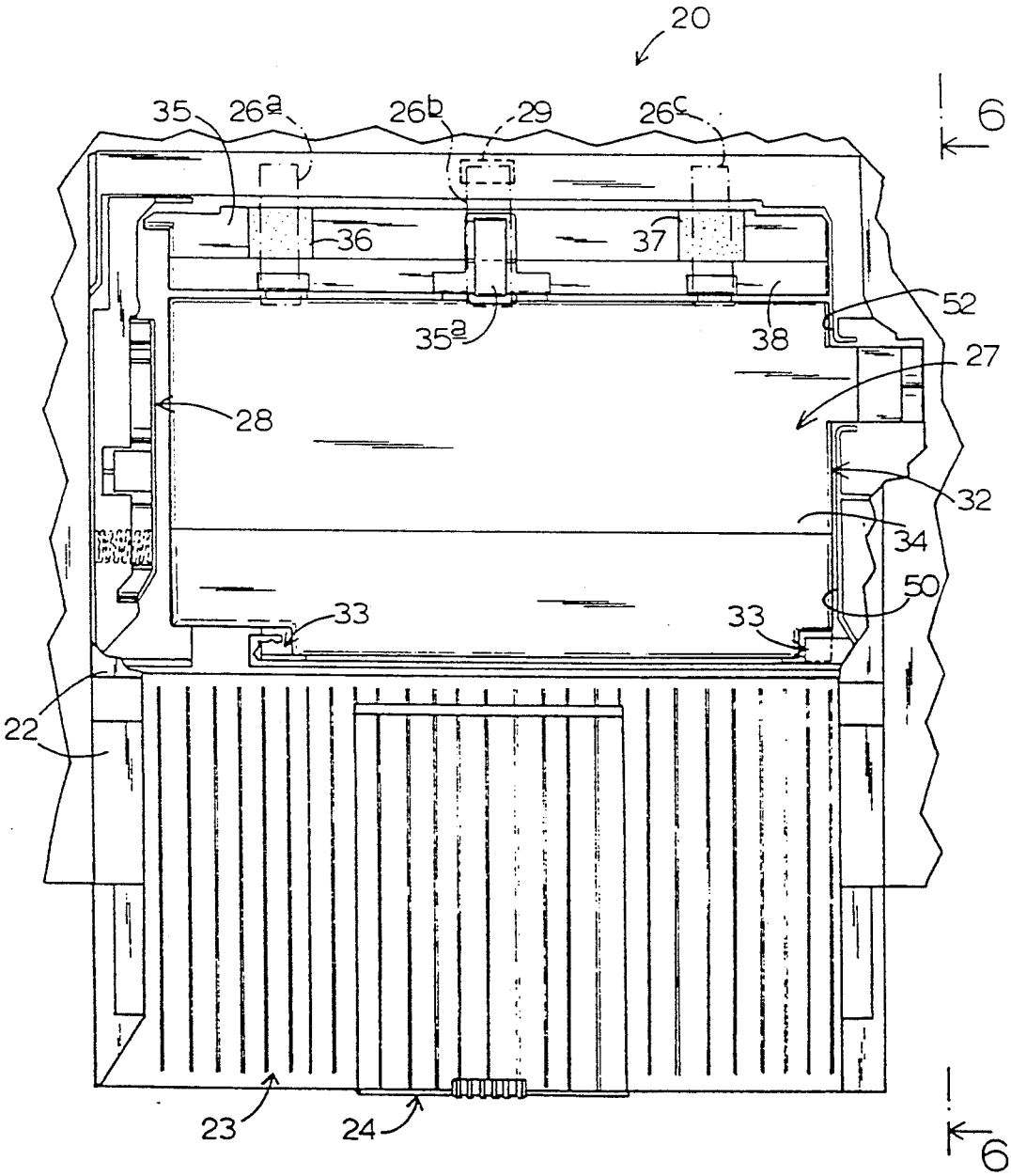
FIG. 2 is a top view of a pressure plate, wrapper, media edge contacter, and back-out restraint constructed according to the invention, and included in the printer of FIG. 1.
Figure 3:
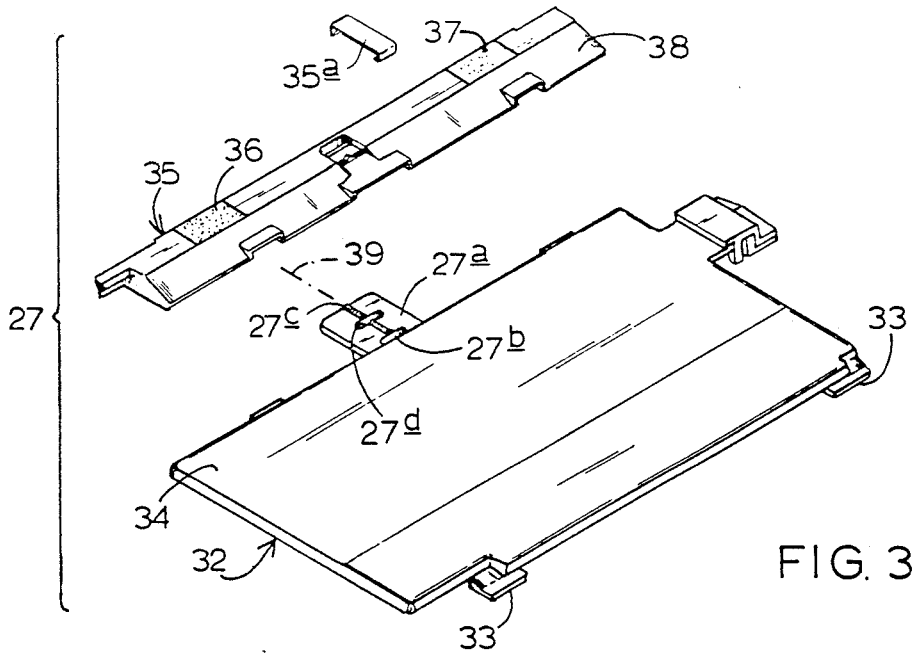
FIG. 3 is an exploded, top perspective view of the pressure plate shown in FIG. 2.

In the embodiment shown in FIGS. 2–5, member 35 is movably attached to a tab extension **27*a* of plate 27 by a clip 35*a*. As shown in FIG. 2, clip 35*a* extends over the center section of member 35 and attaches the member to tab extension 27*a*. One end of the clip extends over the end of the tab extension and the other end of the clip extends through a slot 27*b*** in the tab extension and over an edge of the slot.

Figure 4:
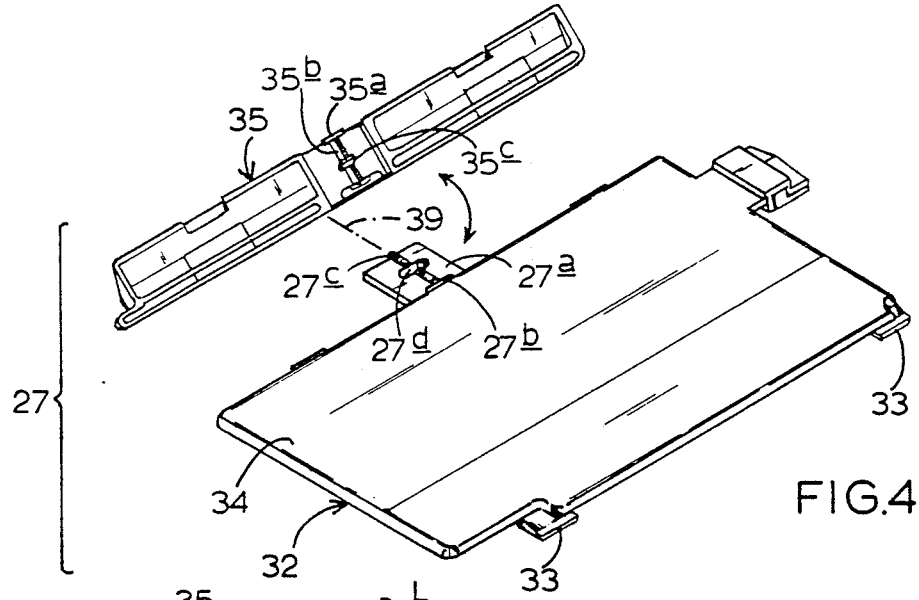
FIG. 4 is an exploded perspective view of the pressure plate shown in FIG. 2, showing the top of a platen and the bottom of a moveable member that make up the plate.

Tab extension **27*a* includes a fulcrum 27*c* shown in FIG. 4. The fulcrum is positioned in a trough 35*b* on member 35, also shown in FIG. 4. The fulcrum allows member 35 to rock back and forth around axis 39. Clip 35*a* and the tab projection itself both limit the rocking of member 35**.

Figure 5:
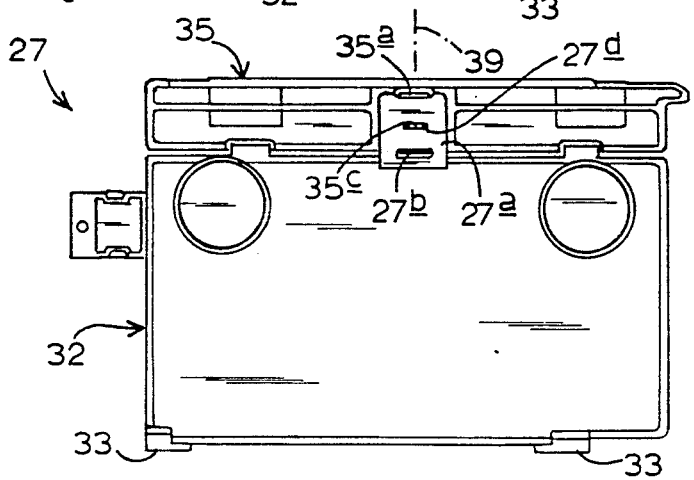
FIG. 5 is a bottom view of the pressure plate shown in FIG. 2.

Member 35 is positioned on the tab extension of plate 27 by a central projection **35*c*. The central projection extends down from the bottom of member 35 and through an aperture 27*d* in the tab extension, as shown in FIGS. 4 and 5**.

During use, paper in tray 23 rests on plate 27 and recessed area 34 ensures that the paper rests on projections 36 and 37. Surface 38 allows paper to be inserted into tray 23 and onto projections 36 and 37. The just-referred to wobble connection which exists between the platen and the moveable member functions, during normal paper handling, to promote, as near as possible, simultaneous gripping of a sheet of paper on its opposite lateral sides. The near simultaneous gripping of a sheet of paper happens because, as plate 27 is raised, the ends of member 35 contact rollers **26*a* and 26*c*. If one end of member 35 contacts a roller prior to the other end contacting the other roller, then the force of the contact causes member 35 to rock around axis 39 until the other end of member 35 contacts the other roller. Both ends of member 35 also contact rollers 26*a* and 26*c* with substantially equal force because member 35 rocks freely around axis 39 and because axis 39 is approximately centered between the two ends of member 35**.

Figure 6:
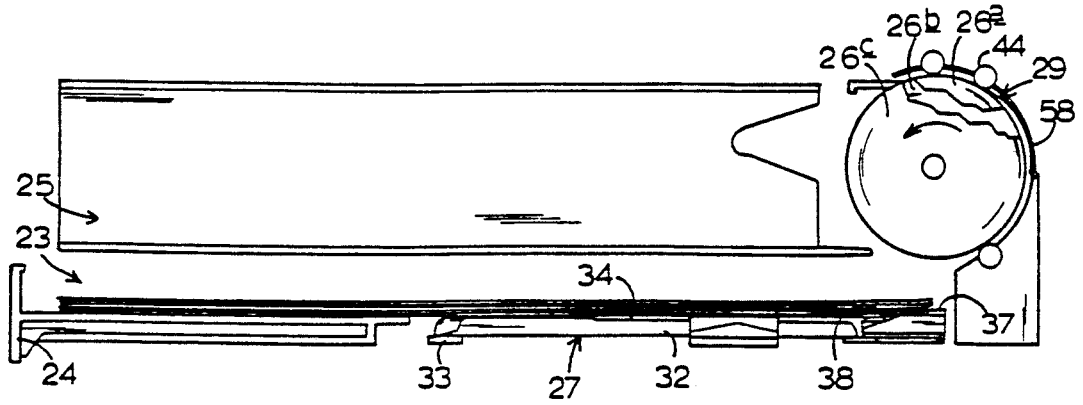
FIG. 6 is a simplified cross-sectional view of the printer of FIG. 1, taken generally along line 6—6 in FIG. 2, and rotated 90° clockwise.
Figure 7:
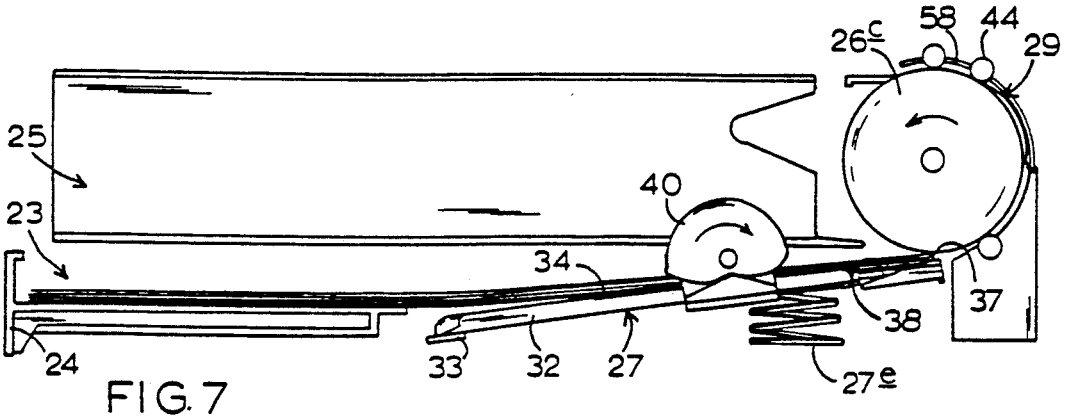
FIG. 7 is similar to FIG. 6, differing in that it shows the beginning of a paper feed cycle.
Figure 8:
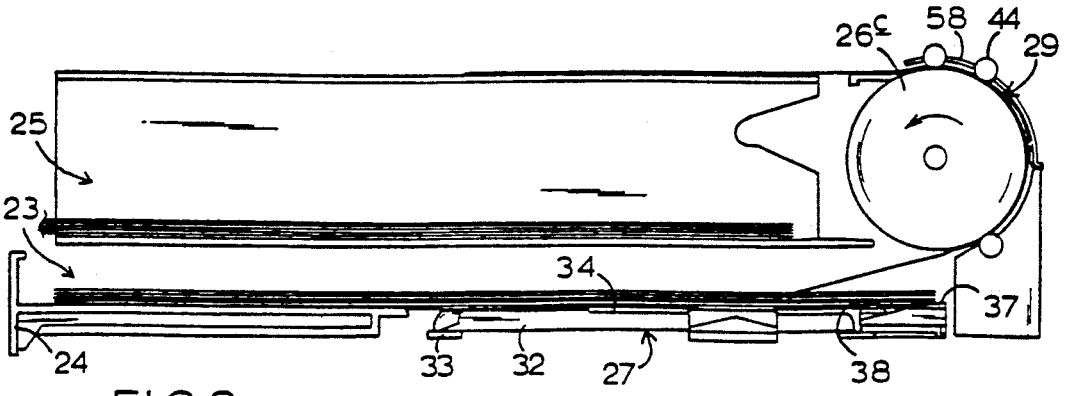
FIG. 8, similar to FIG. 6, shows the path the paper follows in the printer.

Turning to FIGS. 6–8, inclusive, these three figures illustrate three time-successive stages in a typical paper pick/feed cycle of operation. In particular, FIG. 6 illustrates the waiting-to-be-picked situation with a stack of paper residing in proper position in lower tray 23 with the downstream or lead edges of the stack resting on projections 36, 37 beneath rollers **26*a*, 26*b*, 26*c*, which are rotating in the direction of the curved arrow in FIG. 6**.

In FIG. 7, through operation of a cam shown generally at 40 (which cam is omitted from FIGS. 6 and 8), plate 27 is raised and lowered to place the downstream edge of the top sheet of paper in the stack in contact with the drive rollers. As shown in FIG. 7, plate 27 is spring-biased upward by spring **27*e*. As cam 40 is rotated, the cam's shape allows plate 27 to be raised and lowered. As was suggested earlier, the wobble connection which exists between the platen and moveable member 35 tends to insure that opposite sides of this sheet contact the outer drive rollers 26*a*, 26*c* in near time simultaneity and with substantially equal force. As shown in FIGS. 2 through 8, member 35 is raised and lowered with plate 27, while remaining free to rock around axis 39**.

Finally, FIG. 8 illustrates a subsequent stage wherein the pressure plate has been re-lowered, and the paper which was picked in FIG. 7, is on its way into the paper path, toward and through the printing zone in the printer.

Figure 9:
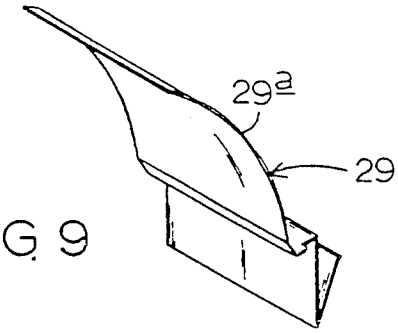
FIG. 9 is a perspective view of a wrapper (isolated from other structure) constructed according to the invention.
Figure 10:
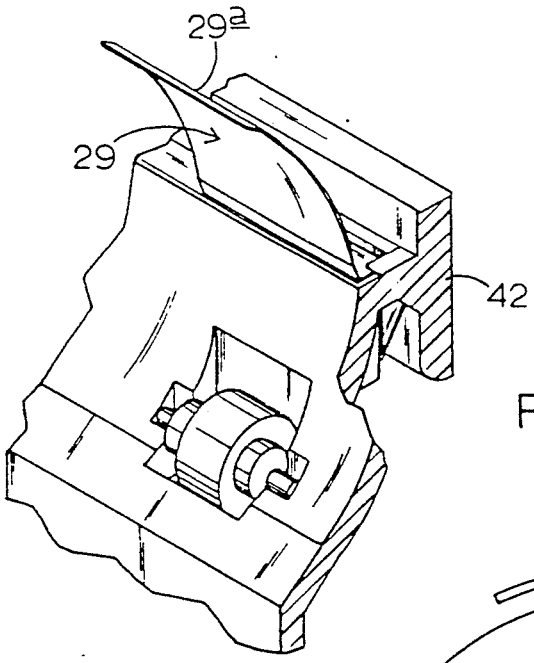
FIG. 10 is a perspective view of the wrapper in a mount.
Figure 11:
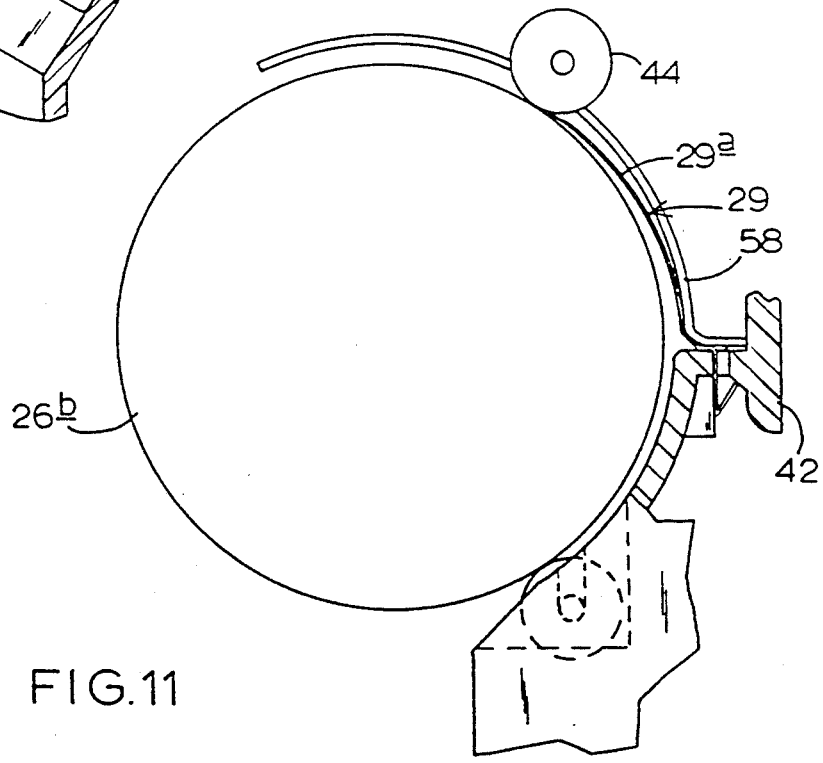
FIG. 11 is a simplified, side cross-sectional view of the wrapper shown in FIG. 10, taken generally in the plane which exposes drive roller **26*b* in FIG. 6**.

Turning attention now to another one of the important anti-skew structures incorporated according to the present invention, and directing particular attention to FIGS. 9–11, previously mentioned wrapper 29 is illustrated. Wrapper 29, illustrated in freestanding form in FIG. 9, is formed preferably of a thin sheet of specially bent springy metal having the nominal configuration illustrated in this figure. As may be noted by looking back and referring to FIG. 2, the wrapper is a singular unit employed centrally (in a lateral sense) in the printer. It occupies a location immediately adjacent central drive roller **26*b***.

In FIG. 10 wrapper 29 is shown snap-seated in a suitable socket provided in a structural mount 42 which is formed in any suitable manner in the usual chassis structure which forms part of printer 20. Wrapper 29 includes a curved arm **29*a* which is intended to curl adjacent drive roller 26*b*, as seen in FIG. 11, and to urge and hold paper against the drive roller. Considering another way in which the wrapper, and more particularly the wrapper's arm functions, the same tends to direct paper precisely into the nip region which exists, as shown in FIG. 11, between drive roller 26*b* and a pinch roller 44**.

Figure 12:
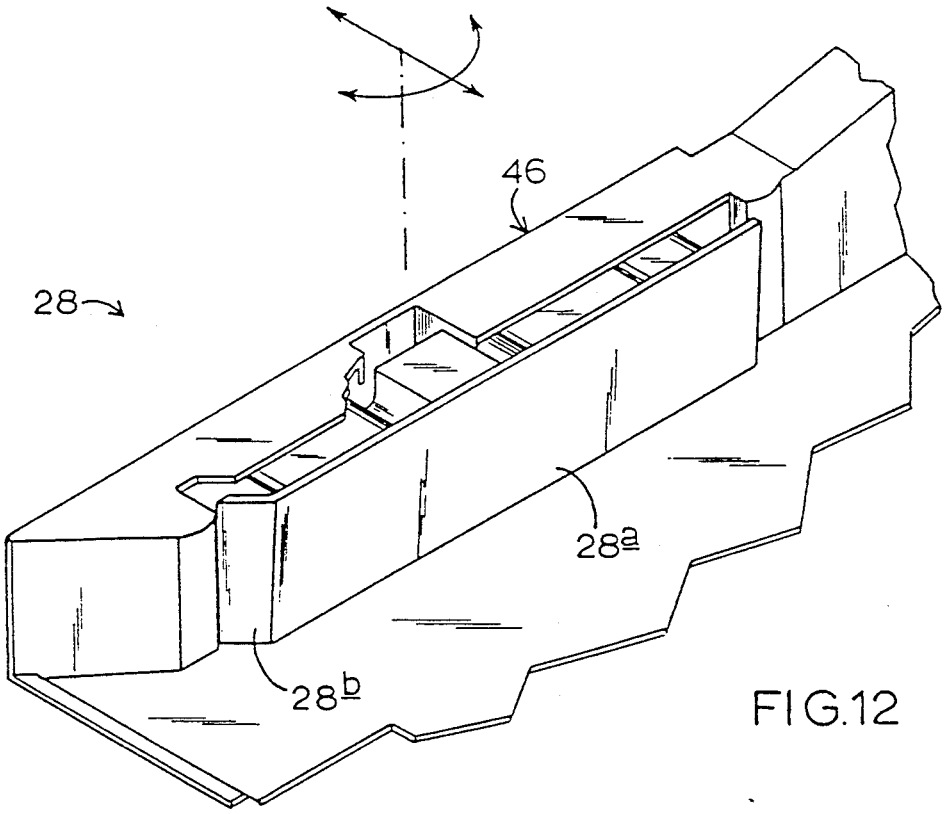
FIGS. 12–14, inclusive, show different views of a media edge contacter constructed according to the invention.
Figure 13:
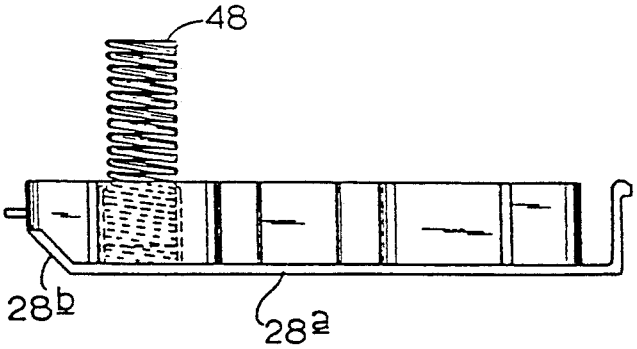
Figure 14:
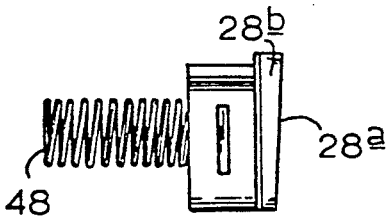

Referring to FIGS. 12–14, inclusive, along with FIG. 2, details of previously mentioned media edge contacter 28 are illustrated. In the particular embodiment shown in the drawings, the edge contacter takes the form of an elongate structure which is long in the direction that it extends along the side of a stack of paper contained in lower tray 23. As can be seen in FIG. 2, this edge contacter lies substantially along the length of the side of pressure plate 27.

Edge contacter 28, which may preferably be a molded plastic part, includes an elongated pad face **28*a*, which provides for surface/edge contact with paper in a stack, joining with a flange lead-in surface 28*b***.

Edge contacter 28 sits in a relatively moveable but captured condition in a mount 46 which allows for limited angulation and reciprocation of the contacter relative to the mount, as indicated generally by the overhead pair of double-ended arrows. Biasing the edge contacter away from mount 46, the condition in which it is shown in FIG. 12, is a biasing spring 48 which acts between the mount and the contacter, located toward the lead end of the contacter (which condition is apparent from the opened-up top view illustrated in FIG. 13).

Considering the action contribution of contacter 28 in the handling of paper, lead-in surface 28*b* facilitates feeding in of a stack of paper, and pad face 28*a* functions, as now will be more particularly explained, to urge the stack of paper laterally toward an appropriate held condition against opposing support guide walls, shown at 50, 52 on the right side of FIG. 2. With specific reference to this kind of performance, and referring especially to FIG. 14, pad face 28*a* has an almost imperceptible incline, sloping upwardly and to the right in the figure, at an angle of around 87° to the normal. This results in assuring that those sheets of paper which are at the top of the stack in tray 23 are prealigned against the guide walls, in a proper position for guidance into the feed path following picking by the rollers.

The location of biasing spring 48 along the length of the contacter, and more specifically toward the infeed end of the contacter, vis-a-vis the way in which paper is inserted into the tray, assures good control over what might be thought of as rear end fishtailing of a sheet of paper is the same as pulled into the paper feed path. Thus, the edge contacter plays a multi-functional role in dealing with the problem of skew, which role is enhanced by the relative positions and sizes of its active faces 28*a* 28*b*, the inclination, in a vertical sense, of face 28*a*, and the near end biasing position for action of spring 48.

Figure 15:
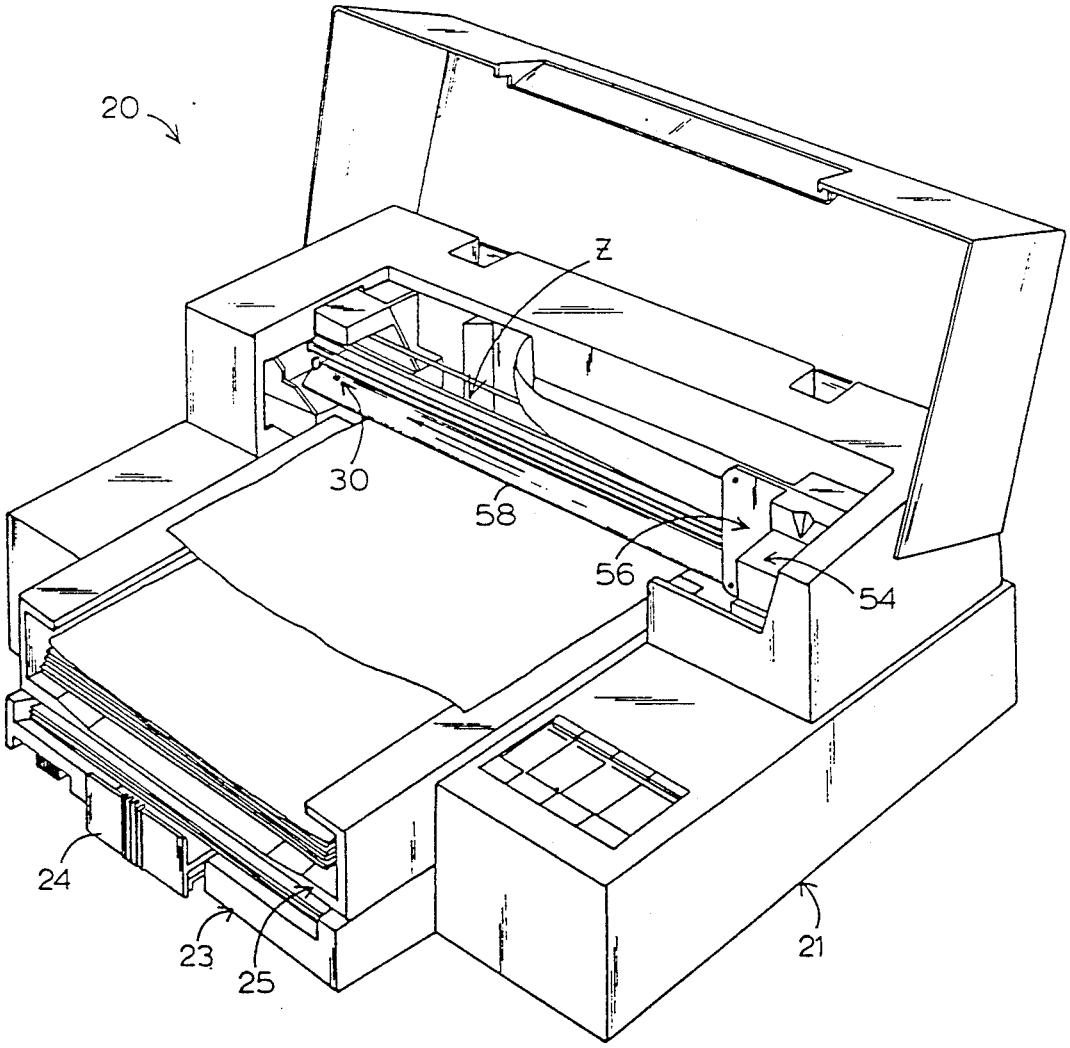
FIG. 15 is a view like that presented in FIG. 1, with a portion of the printer's housing shifted to expose a carriage guide included in the printer.

Looking now at FIG. 15, here in this perspective view of printer 20, print zone Z is again illustrated. Included within this zone are a printhead cartridge 54, a printhead carriage 56 and a carriage guide 58. Cartridge 54 moves back and forth in carriage 56, along guide 58, and prints on paper traveling through the print zone.

Figure 16:
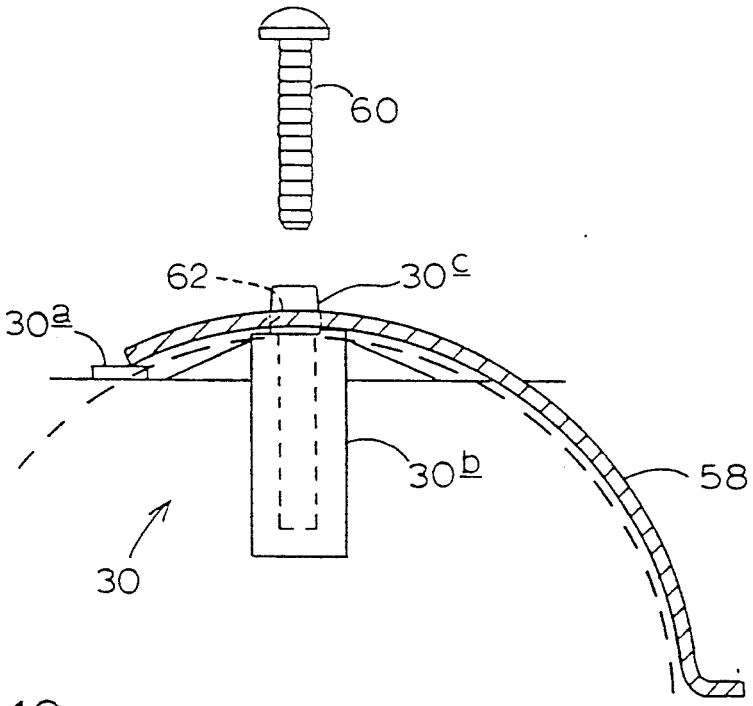
FIG. 16 is a simplified and enlarged cross-sectional view of the carriage guide, taken generally in the region, and direction, of the arrow in FIG. 15, disclosing support mounts provided for the guide.

Looking at FIG. 16 along with FIG. 15, cooperating with the carriage guide, as the same is seeing adjacent the left end of the print zone in FIG. 15, is previously mentioned carriage guide support, or support means, 30, which includes three cooperating components illustrated at 30*a*, 30*b*, 30*c*. Component 30*a* takes the form of a horizontal support pad which defines a fixed vertical support datum plane for the left free end or leading edge of the carriage guide as seen in FIG. 16—allowing the guide to slide from left to right in FIG. 16, but not to change, in a lowering sense, its elevation. Component 30*b* takes the form of a molded boss with a threaded screw hole underlying the carriage guide, in alignment with a clearance hole in the guide through which a securing screw, such as that shown in upwardly exploded condition at 60, is fastened. Component 30*b* includes a step in its upper surface which serves to force the carriage guide against component 30*a* when screw 60 secures the carriage guide. Component 30*c* acts as a stabilizing key, by fitting into a lateral notch 62 formed in the carriage guide. This cooperative interaction prevents the carriage guide in its entirety from shifting to the left or the right in FIG. 16. The upper horizontal surface of support component 30*a* functions herein as a first horizontal support surface. Component 30*c* acts herein as a second support. Similar support means may be included at the right end, as seen in FIG. 15, of guide 58.

The support means 30, functions to reduce printhead carriage rocking and to provide tolerance for imperfections or warping in the carriage guide. As the printhead carriage moves back and forth on the guide, the printhead is held a certain distance from the paper. Support means 30 helps maintain the position of the printhead relative to the paper.

Figure 17:
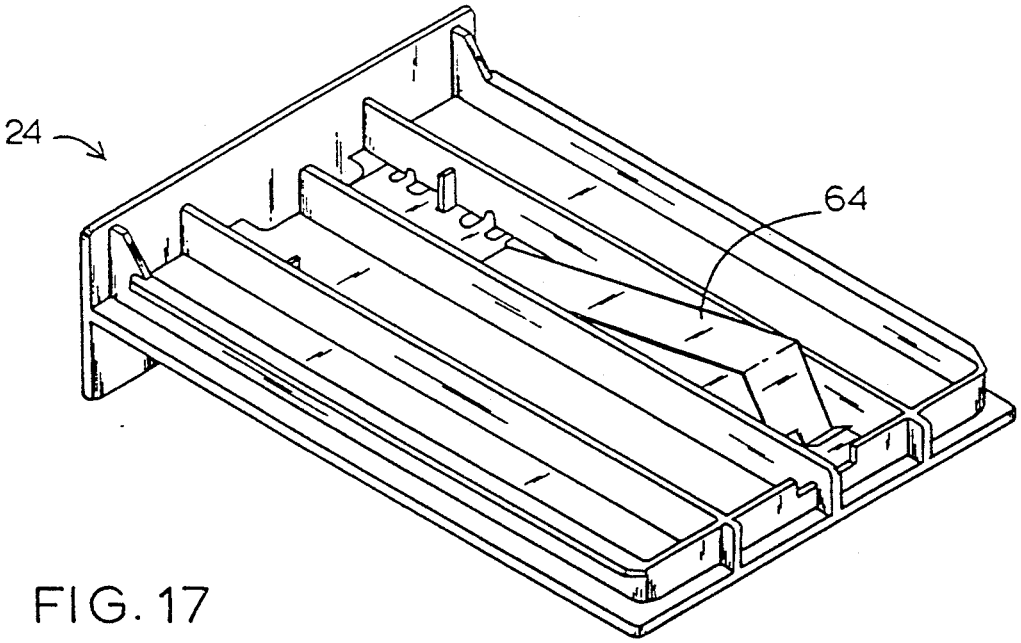
FIG. 17 is a bottom view of a back-out restraint.

Completing now a description of the present invention, FIG. 17 shows a bottom side perspective view of previously mentioned back-out restraint 24. With a stack of paper stored in tray 23, the repeated raising and lowering action of plate 27 prompts gravity to cause sheets in the stack to tend to back out of the tray. Restraint 24 is intended to counter this tendency, and yet not to be a hinderance to the insertion of paper into the tray when loading is necessary. Enabling this all to occur in a very simple structure is a leaf spring shown at 64 mounted on the underside of the restraint (the upper side in FIG. 17). Spring 64 allows for frictional sliding contact with tray 23. Thus, when one desires to insert paper into the tray the restraint is slid back, paper is inserted, and the restraint slid back into the position in which it is shown in FIGS. 1 and 15 snugly maintaining paper in proper location. Obviously this cooperates with the other anti-skew mechanisms in assuring that, at the beginning of each feed cycle, and certainly after repetition of feed cycles each newly presented top sheet of paper is in the appropriate position vis-a-vis its front-/back location in the tray.

From the description which has been given above with respect with the several improvement mechanisms which deal with the problem of skew, the concerns outlined earlier herein are clearly dealt with in a simple and effective manner.

INDUSTRIAL APPLICABILITY

The invented printer with improved anti-skew performance is applicable to many printing systems. It provides a low-cost manner of preventing skew. While the best mode and preferred embodiment of the invention have been described, variations and changes may be made without departing from the spirit of the invention.

What is claimed is:

1. A printer with improved anti-skew performance comprising:

a tray for print media;

a drive mechanism including a drive roller for feeding print media from said tray into the printer; and a pressure plate, operatively associated with said drive mechanism, said pressure plate having a hinged platen and a relatively moveable member mounted on said platen and capable of movement around an axis substantially parallel to the direction in which print media is fed away from said tray into the printer, for bringing such media into contact with said roller.

2. The printer of claim 1, wherein said platen has a recessed area and said moveable member includes two raised projections laterally-spaced on said member, where the recessed area insures that the print media contacts the two raised projections.

3. The printer of claim 1, further including a media edge contacter operatively associated with said drive mechanism, said media edge contacter having a pad that extends longitudinally along such media along a line disposed substantially within the plane of such media and that presses against the media as the same is fed into the printer by the drive roller, a mount, and a spring attached between said mount and said pad, for biasing the pad toward such media, wherein said spring is connected to said pad in such a manner that said pad resists lateral shifting of such media with more force at one point than at a second point.

4. A printer with improved anti-skew performance comprising:

a drive mechanism including a drive roller for feeding print media into the printer; and a media edge contacter operatively associated with said drive mechanism, said media edge contacter having a pad that extends longitudinally along such media along the line disposed substantially within the plane of such media and that presses against the media as the same is fed into the printer by the drive roller, a mount, and a spring attached between said mount and said pad, for biasing said pad toward such media, wherein said spring is connected to said pad in such a manner that said pad resists lateral shifting of such media with more force at one point than at a second point.

5. The printer of claim 4, wherein said pad is of a predetermined length to substantially prevent such media from shifting laterally when such media is fed into the printer by said roller.

6. The printer of claim 4, wherein such media is a stack of sheets and said pad includes a face that is angled to provide top-sheet preferential contact.

7. A printer with improved anti-skew performance comprising:

a drive mechanism including a drive roller for feeding print media into the printer;

a wrapper curving around a portion of said roller; and a media edge contacter having a pad that extends longitudinally along such media along a line disposed substantially within the plane of such media and that presses against the media as the same is fed into the printer by the drive roller, a mount, and a spring attached between said mount and said pad, for biasing said pad toward such media, wherein said spring is connected to said pad in such a manner that said pad resists lateral shifting of such media with more force at one point than at a second point.

* * * * *